US005265935A

United States Patent [19]

Geisler et al.

[11] Patent Number: 5,265,935

[45] Date of Patent: Nov. 30, 1993

[54] STAND-ASSIST RECLINER CHAIR

[75] Inventors: Gerhard Geisler; Klaus Hausherr, both of Wetter, Fed. Rep. of Germany

[73] Assignee: Stanzwerk Wetter Sichelschmidt & Co., Wetter, Fed. Rep. of Germany

[21] Appl. No.: 813,435

[22] Filed: Dec. 24, 1991

[30] Foreign Application Priority Data

Oct. 9, 1991 [DE] Fed. Rep. of Germany ... 9112558[U]

[51] Int. Cl.[5] ..... A47C 1/02

[52] U.S. Cl. ..... 297/325; 297/DIG. 10; 297/85; 297/342; 297/330

[58] Field of Search ..... 297/325, 85, 84, 327, 297/330, 341, 342, 358, DIG. 10

[56] References Cited

U.S. PATENT DOCUMENTS

| | | | |
|---|---|---|---|
| 1,025,915 | 5/1912 | Hoff | 297/DIG. 10 |
| 4,083,599 | 4/1978 | Gaffney | 297/DIG. 10 |
| 4,581,778 | 4/1986 | Pontoppidan | 297/DIG. 10 |
| 5,024,486 | 6/1991 | Auel | 297/DIG. 10 |
| 5,076,644 | 12/1991 | Northcutt | 297/DIG. 10 |

*Primary Examiner*—Laurie K. Cranmer

*Attorney, Agent, or Firm*—Herbert Dubno; Andrew Wilford

[57] ABSTRACT

A stand-assist chair has a base, front and back wheels on the base normally supporting it rollably on a floor, a seat having a front edge and a back edge, a back extending upward from the back edge of the seat, and a pair of lever systems engaged between the seat and the base operable to displace the seat between a normal sitting position with the seat front edge somewhat above the seat rear edge and a stand-assist position with the seat rear edge somewhat above the seat front edge and the entire seat elevated above the level it occupies relative to the base in the normal sitting position. A drive motor is engaged with the lever system for displacing the seat between its positions. A pair of respective feet are movable on the base between a retracted position above a plane defined by lowermost surfaces of the wheels and an extended position projecting downward past the plane and lifting at least one of the wheels off the floor. Links are connected between the lever systems and the feet for automatically displacing the feet into the extended position when the seat is in the stand-assist position.

7 Claims, 4 Drawing Sheets

STAND-ASSIST RECLINER CHAIR

FIELD OF THE INVENTION

The present invention relates to a chair. More particularly this invention concerns a chair that is set up to provide assistance to an invalid in the like while rising from the chair.

BACKGROUND OF THE INVENTION

A standard stand-assist chair has a frame on which are supported a generally horizontal seat and a generally vertical back. During normal use the seat is inclined somewhat downward from its front edge to its rear edge and the back is inclined somewhat back from its lower edge to its upper edge. To assist a disabled person in rising from the chair, it can be moved into a position with the seat cushion elevated somewhat and tipped forward with its rear edge above its front edge and normally also with the back vertical or forming less of an acute angle to the vertical than normal.

The seat and back are normally mounted via a system of levers on a base of the frame. An electric motor is typically provided to act upon the lever system and move the seat and back into the desired assist position.

As a rule such a chair is provided with casters or wheels so that it can be moved fairly easily, even with the person in it. These wheels make the chair fairly skittish, however, so that when rising from it it is possible for the user to push it backward. Locks may be provided on the wheels, but they require special attention and are either locked when someone wants to move the chair, or they are forgotten so the chair shoots back when someone is rising from it.

OBJECTS OF THE INVENTION

It is therefore an object of the present invention to provide an improved stand-assist chair.

Another object is the provision of such an improved stand-assist chair which overcomes the above-given disadvantages, that is which can roll about easily when in the normal sitting position, but that is very stable when in the stand-assist position.

SUMMARY OF THE INVENTION

A stand-assist chair according to the invention has a base, front and back wheels on the base normally supporting it rollably on a floor, a seat having a front edge and a back edge, a back extending upward from the back edge of the seat, and a pair of lever systems engaged between the seat and the base operable to displace the seat between a normal sitting position with the seat front edge somewhat above the seat rear edge and a stand-assist position with the seat rear edge somewhat above the seat front edge and the entire seat elevated above the level it occupies relative to the base in the normal sitting position. A drive motor is engaged with the lever system for displacing the seat between its positions. According to the invention a pair of respective feet are movable on the base between a retracted position above a plane defined by lowermost surfaces of the wheels and an extended position projecting downward past the plane and lifting at least one of the wheels off the floor. Links are connected between the lever systems and the feet for automatically displacing the feet into the extended position when the seat is in the stand-assist position.

Thus with the system of this invention as the chair is moved into the stand-assist position it is lifted off two of its wheels, normally the front wheels, by the feet which cannot roll. In this manner when in the stand-assist position the chair cannot roll at all and is very stable.

In accordance with further features of the invention each lever system includes a pair of centrally pivoted levers one of which has a front end pivoted on the seat and the other of which has a front end pivoted on the base and each of which has a rear end and a pair of links one of which has a lower end pivoted on the base and an upper end pivoted on the rear end of the one lever and the other of which has an upper end pivoted on the seat and a lower end pivoted on the rear end of the other lever. This system can easily be set up with appropriate lever lengths and pivot locations so that it coordinates the desired tipping action with the lifting motion.

Furthermore according to the invention each foot is pivotal between the respective positions and each one link has an upward extension from its upper end. Each lever system further includes a connecting rod connected between each extension and the respective foot. The drive means has a traverse rod rotatable in the seat, respective cranks extending from the rod adjacent the lever systems, another respective link connected between each crank and the base, and a motor for rotating the traverse rod.

The chair back according to the invention can pivot on the seat between a reclining position forming a large obtuse angle therewith and an upright position forming a smaller angle therewith. A linkage is provided between the back and the motor for moving the back into the reclining position on actuation of the motor means in the sitting position of the seat. The lever systems are so constructed that operation of the motor means in one direction displaces the seat from the stand-assist position to the normal sitting position and thereafter displaces the back into the reclining position. In addition a foot rest is displaceable at the front edge of the seat between an extended generally horizontal position and a retracted upright position. Another link connects the foot rest to the back for displacement of the foot rest into the horizontal position on displacement of the back into the reclining position. A remote actuator with individual buttons for the three desired functions—normal sitting, reclining, and stand-assist—is provided for operating the motor.

BRIEF DESCRIPTION OF THE DRAWINGS

The above and other objects, features, and advantages will become more readily apparent from the following, reference being made to the accompanying drawing in which.

SPECIFIC DESCRIPTION

Figure 1:
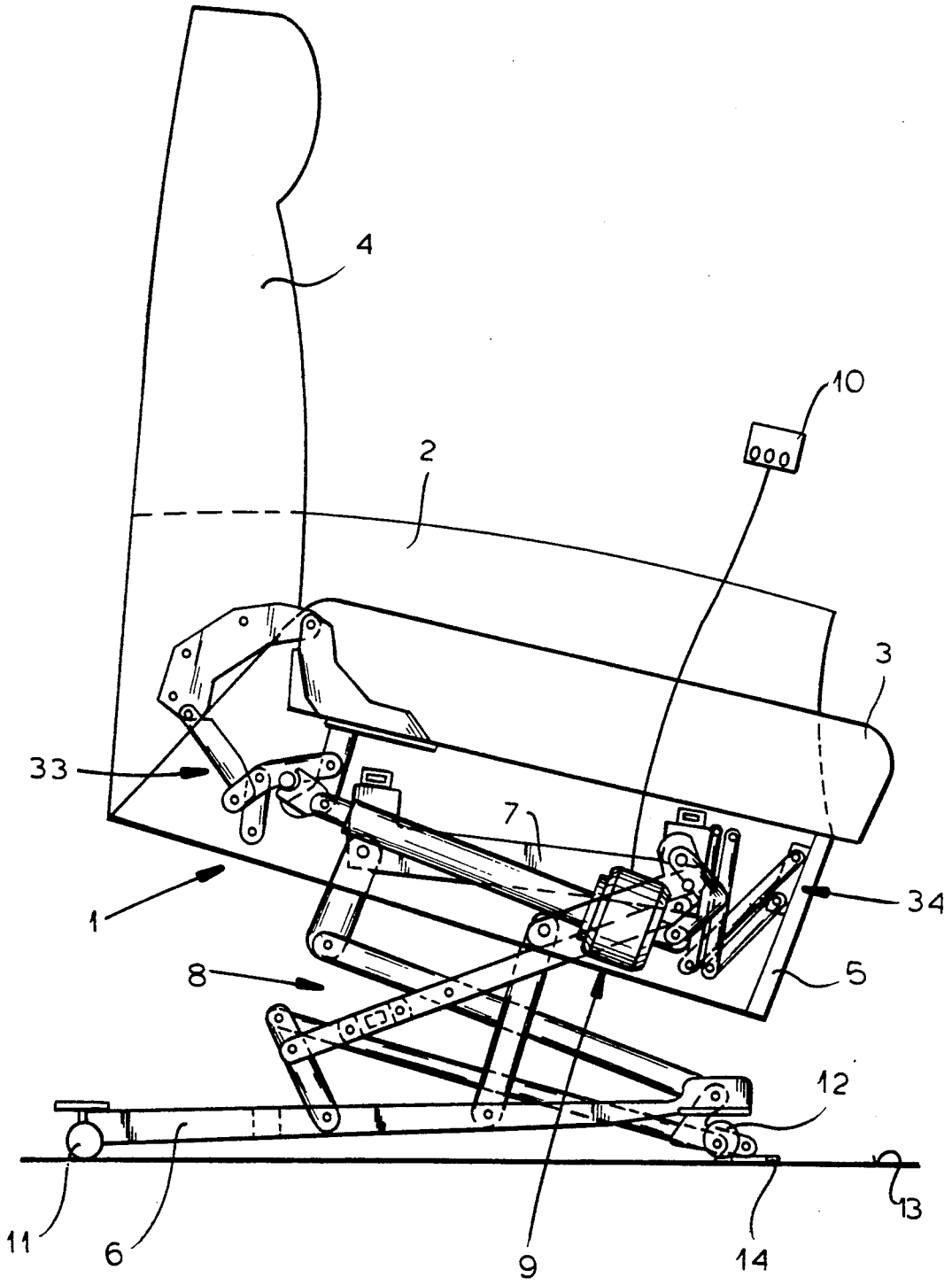
FIG. 1 a side view with some parts shown schematically and/or in section of a chair according to this invention in the stand-assist position.

As seen in FIG. 1 a stand-assist chair 1 according to this invention basically has a pair of arms 2 fixed to a seat 3, a back 4, and a pivotal foot rest 5, all connected via a seat frame 7 to two lever systems 8 that in turn are mounted on a base frame 6. A motor 9 operated by a three-button remote controller 10 can displace the chair between the raised stand-assist position of FIGS. 1 and 3 and the sitting position of FIGS. 2 and 4. The base frame 6 has rear wheels 11 and front wheels 12 by means of which it is supported on a horizontal and planar floor 13 so that the chair can be moved about easily.

Each of the two identical lever systems 8, which flank the seat 3 to support it stably, comprises a pair of main levers 15 and 15' pivoted centrally together and having front ends respectively pivoted on the seat frame 7 and the base frame 6. The rear ends of the levers 15 and 15' are respectively pivoted at 16 and 16' on the upper and lower ends of links 17 and 17' having lower and upper ends in turn pivoted on the frames 6 and 7. These levers 15 and 15' and links 17 and 17' serve primarily to maintain the seat 3 level from side to side as it is raised and lowered and also serve to create the desired forward-tipping action as the seat 3 is raised.

Figure 2:
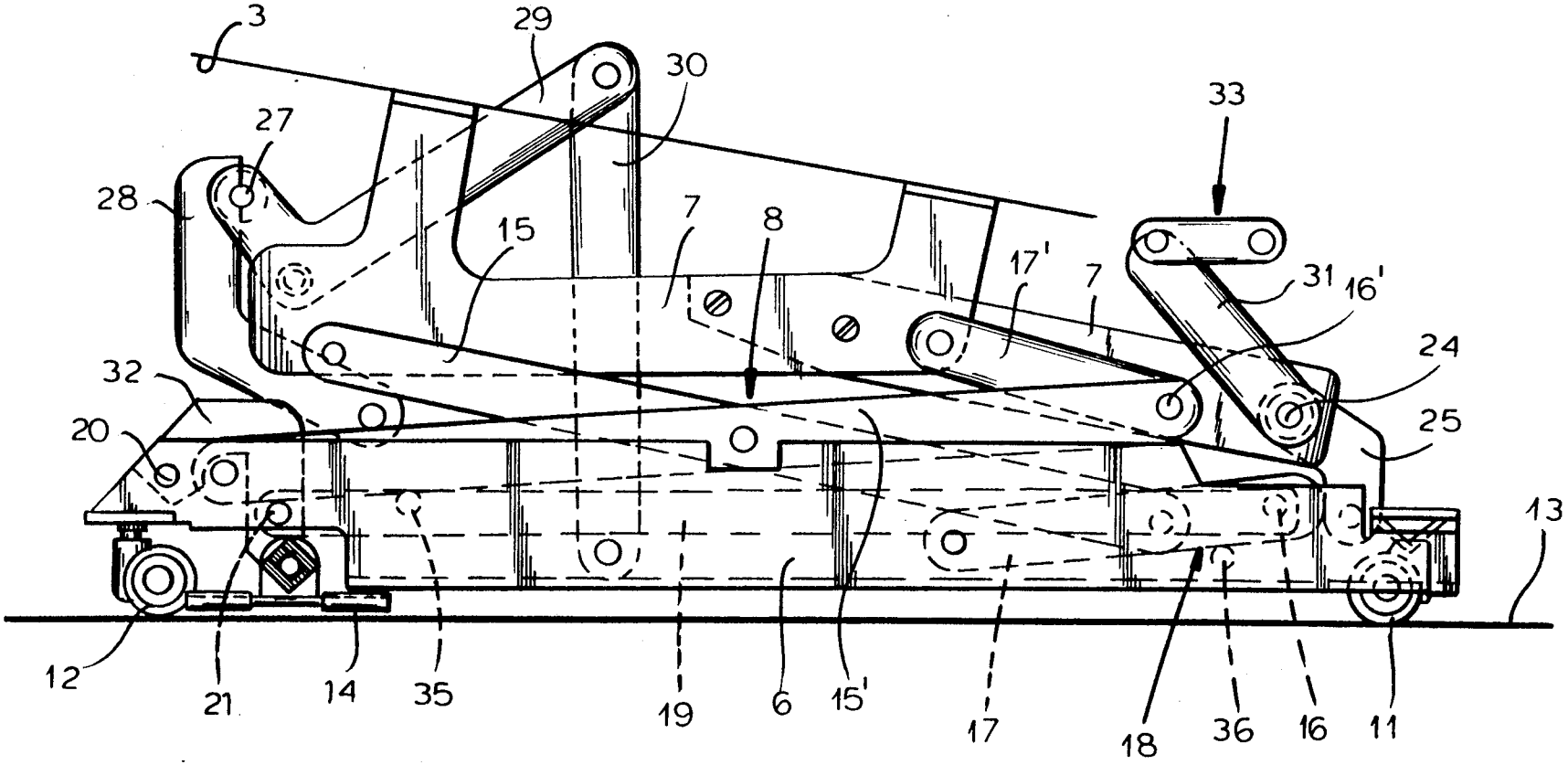
FIGS. 2 and 3 are larger-scale views of the lever systems in the sitting and the stand-assist positions, respectively, these views being taken from the opposite side as that of FIG. 1.
Figure 3:
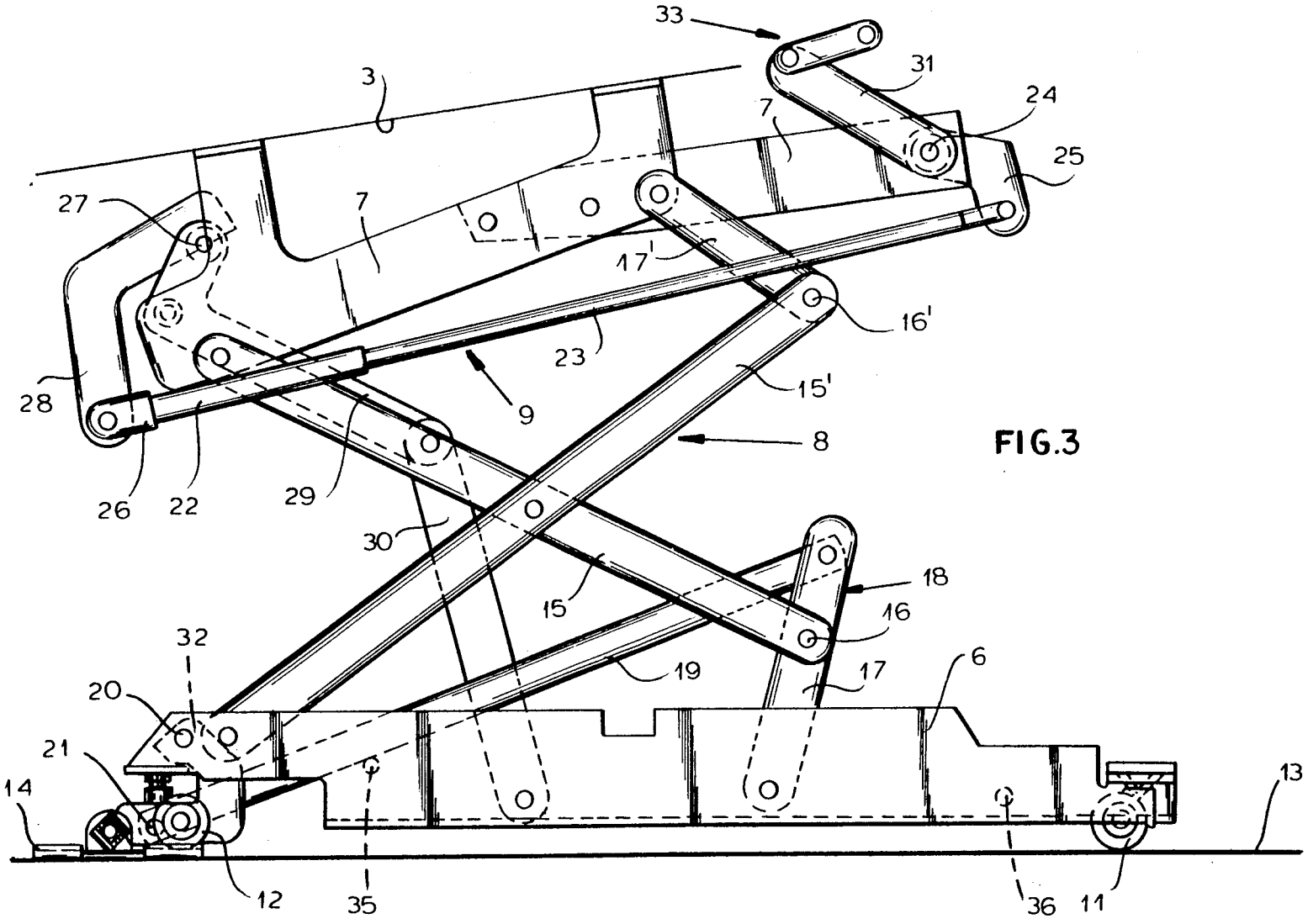
Figure 4:
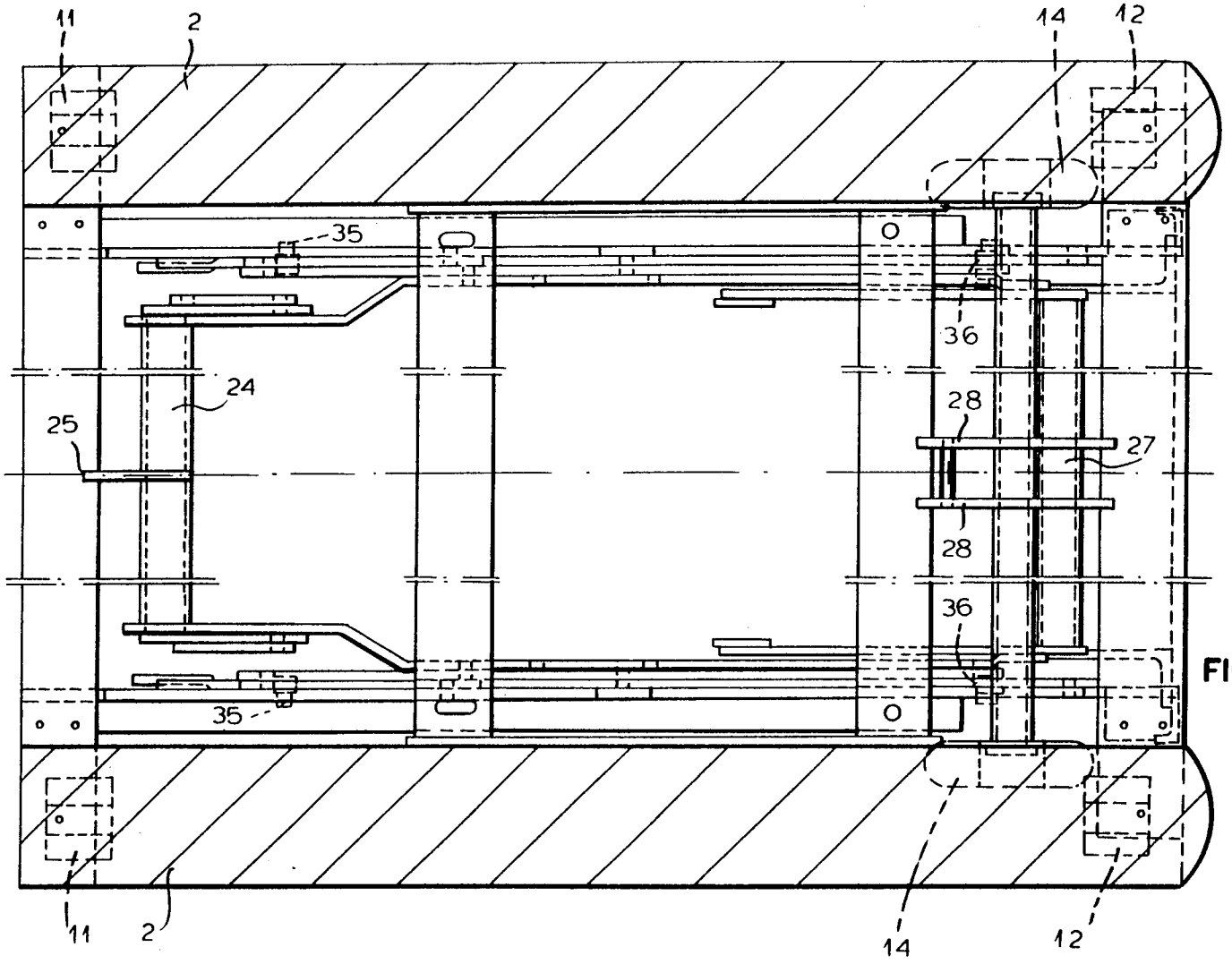
FIG. 4 is a horizontal section through the chair in the sitting position with the view reversed as in FIG. 1.

The motor or actuator 9 that is not shown fully in FIGS. 2 through 4 for clarity of view is typically an electric motor that relatively rotates an internally threaded sleeve 22 and an externally threaded spindle 23 received therein to increase and decrease their overall length. The nut 22 is attached at 26 to a crank arm 28 carried on a crosswise shaft 27 pivoted in the seat frame 7. This shaft 27 carries as also shown in FIG. 4 a pair of crank arms 29 having outer ends pivoted to the upper ends of links 30 whose lower ends are pivoted on the frame 6 somewhat centrally. Thus as seen in FIGS. 2 and 3 extension of the actuator 9 will pivot the shaft 27 clockwise and push the frame 7 up away from the frame 6. In the lowered normal-use position as shown in FIG. 2 each lever 15' rests on a stop 35 in the frame 6 and each link 17 on a stop 36. These stops 35 and 36 can be associated with respective end or limit switches so that once the end position is reached the actuator 9 is shut off, at least temporarily.

The other end of the actuator 9 is connected to a crank arm 25 carried on a crosswise shaft 24 from which extends crank arm 31 connected to a linkage 33 that changes the angle of the back 4. The linkage 33 is associated with a linkage 34 that can extend the foot rest 5. Once the normal sitting position is reached, the remote controller 10 is actuated again to move the back 4 and rest 5 into an unillustrated reclining position.

According to this invention a foot 14 is carried on a respective L-shaped arm 32 pivoted at 20 on the base frame 6 adjacent each front wheel 12. Thus the foot 14 can pivot from a position elevated slightly above the plane defined by the lowermost portions of the wheels 11 and 12 to a position projecting slightly downward past this plane. This pivoting of each foot 14 is controlled by an actuating arm 19 having a front end pivoted at 21 on the respective foot arm 32 and a rear end pivoted at the upper end of an extension 18 of the link 17. The system is set up, so that as the seat 3 is raised the feet 14 are pivoted down to engage the floor 13 behind the respective front wheels 12 and lift the front wheels 12 off the floor 13 and then move forward underneath the respective front wheels 12 while in engagement with the floor 13. Once the stand-assist position is reached the wheels 12 are completely clear of the floor 13, with the chair supported only on the rear wheels 11 and feet 14, so that rolling of the chair is impossible. This effectively prevents the chair from rolling when in the stand-assist position. In addition such downward extension of the feet 14 pushes the chair back a little on the wheels 11, further assisting the person getting out of it.

We claim:

1. A stand-assist chair comprising:

a base;

front and back wheels on the base normally supporting it rollably on a floor;

a seat having a front edge and a back edge;

a back extending upward from the back edge of the seat;

a pair of lever systems engaged between the seat and the base operable to displace the seat between a normal sitting position with the seat front edge somewhat above the seat rear edge and a stand-assist position with the seat rear edge somewhat above the seat front edge and the entire seat elevated above the level it occupies relative to the base in the normal sitting position, each lever system including a pair of centrally pivoted levers one of which has a front end pivoted on the seat and the other of which has a front end pivoted on the base and each of which has a rear end, and a pair of primary links one of which has a lower end pivoted on the base and an upper end pivoted on the rear end of the one lever and the other of which has an upper end pivoted on the seat and a lower end pivoted on the rear end of the other lever motor means engaged with the lever system for displacing the seat between its positions;

a pair of respective feet movable on the base between a retracted position above a plane defined by lowermost surfaces of the wheels and an extended position projecting downward past the plane and lifting at least one of the wheels off the floor; and link means connected between the lever systems and the feet for automatically displacing the feet into the extended position when the seat is in the stand-assist position.

2. The stand-assist chair defined in claim 1 wherein each foot is pivotal between the respective positions and each one link has an upward extension from its upper end and each lever system further includes a connecting rod connected between each extension and the respective foot.

3. The stand-assist chair defined in claim 1 wherein the motor means includes a traverse rod rotatable in the seat, respective cranks extending from the rod adjacent the lever systems, a respective secondary link connected between each crank and the base, and a motor for rotating the traverse rod.

4. The stand-assist chair defined in claim 1 wherein the back can pivot on the seat between a reclining position forming a large obtuse angle therewith and an upright position forming a smaller angle therewith, the chair further comprising means including a linkage between the back and the motor means for moving the back into the reclining position on actuation of the motor means in the sitting position of the seat.

5. The stand-assist chair defined in claim 1 wherein the lever systems are so constructed that operation of the motor means in one direction displaces the seat from the stand-assist position to the normal sitting position and thereafter displaces the back into the reclining position.

6. The stand-assist chair defined in claim 5, further comprising:

a foot rest displaceable at the front edge of the seat between an extending generally horizontal position and a retracted upright position; and link means connecting the foot rest to the back for displacement of the foot rest into the horizontal position on displacement of the back into the reclining position.

7. The stand-assist chair defined in claim 1, further comprising remote actuating means for operating the motor means.

* * * * *